US007712408B1

(12) United States Patent
Copeland et al.

(10) Patent No.: US 7,712,408 B1
(45) Date of Patent: May 11, 2010

(54) METHODS AND APPARATUS FOR PERSONAL SAFETY

(75) Inventors: David J. Copeland, San Antonio, TX (US); Kermit W. Fox, Jr., Bulverde, TX (US)

(73) Assignee: Pro-Tecks, L.L.C., San Antonio, TX (US)

( * ) Notice: Subject to any disclaimer, the term of this patent is extended or adjusted under 35 U.S.C. 154(b) by 55 days.

(21) Appl. No.: 11/891,448

(22) Filed: Aug. 10, 2007

(51) Int. Cl.
*F41H 5/00* (2006.01)

(52) U.S. Cl. ..... 89/36.01; 248/452; 109/49.5

(58) Field of Classification Search ..... 248/451, 248/452; 281/45; 89/36.01, 36.02, 36.05, 89/36.07; 109/49.5
See application file for complete search history.

(56) References Cited

U.S. PATENT DOCUMENTS 3,766,865 A * 10/1973 Cutler ..... 109/49.5
3,848,547 A * 11/1974 Schaefer ..... 109/49.5
3,866,242 A * 2/1975 Slagel ..... 2/2.5
4,016,666 A * 4/1977 Finn et al. ..... 42/1.09
4,153,927 A * 5/1979 Owens ..... 362/99
4,442,780 A * 4/1984 Child ..... 109/29
4,919,037 A * 4/1990 Mitchell ..... 89/36.05
5,554,816 A * 9/1996 Skaggs et al. ..... 89/36.17
7,004,430 B2 * 2/2006 Weekly ..... 244/129.1
7,146,899 B2 * 12/2006 Imblum et al. ..... 89/36.01
7,302,880 B1 * 12/2007 Elasic ..... 89/36.07
2007/0126224 A1 * 6/2007 Isaacs ..... 281/45

OTHER PUBLICATIONS

Internet printout: http://i5.a248.e.akamai.net/f/248/5462/2h/bodyarmour.safeshopper.com/images/b60ck83h.jpg printed Jun. 5, 2007.
Internet printout: http://i5.ebayimg.com/03/i/08/d6/92/30_2.JPG printed Jun. 5, 2007.
Internet printout: http://i16.ebayimg.com/02/i/08/cc/25/19_2JPG printed Jun. 5, 2007.

* cited by examiner

*Primary Examiner*—J. Allen Shriver, II
*Assistant Examiner*—Steven M Marsh
(74) *Attorney, Agent, or Firm*—Wayne J. Colton, Inc.

(57) ABSTRACT

A personal safety device for protection from a firearm attack includes a conventional accessory item adapted for use other than as a personal safety device and a bullet resistant panel that is integrated into the conventional accessory item. The conventional accessory item may take the form of a clipboard, a backpack or other item. Integration of the panel with the selected item is conducted in such a manner as to cause the panel to be placed in the path of fire when a person engages in natural defensive posturing. The clipboard is provided with a light, multiple spring clips and a suitably sized handle to encourage proper grasp of the clipboard for the intended purpose.

14 Claims, 4 Drawing Sheets

METHODS AND APPARATUS FOR PERSONAL SAFETY

FIELD OF THE INVENTION

The present invention relates to personal safety. More particularly, the invention relates to methods and apparatus adapted for cooperation with a person's natural defensive instincts to provide readily available protection from a firearms attack.

BACKGROUND OF THE INVENTION

Notwithstanding the evolution of society, violent crime persists as a threat to virtually anyone at any time. In fact, with the passage of time, the manner and circumstances in and under which one may fall victim to violence have only increased. For example, firearms are now readily available to virtually any individual desiring to inflict violence and, in the age of instant broadcast of news of violent attacks, any "new" manner of inflicting violence is typically copied by others resulting in "waves" of attacks on law enforcement or security officers, school shootings and the like.

Because no amount of gun control or other preventive measures is likely to result in the unavailability of firearms to the elements of society who truly wish to do harm to others, it is left to the remainder of society to take precautions for personal safety. This fact of life is daily exemplified by the wearing by law enforcement officers of bullet resistant garments and the constant admonishment to children that they should avoid talking to strangers or taking a shortcut home through the proverbial "dark alley."

Unfortunately, the foregoing longstanding measures continue to fall short—law enforcement and security officers are still killed or seriously wounded by gunfire and children or others are still not completely safe even in the most public places. Furthermore, because most people, including law enforcement and security officers, are not routinely the victims of firearms attacks, training in defensive tactics often fails under the stress of an actual attack.

It is therefore a primary object of the present invention to improve upon the personal safety devices presently available by providing personal safety devices that function in cooperation with a victim's natural defensive instincts for the delivery of protection. Additionally, it is an object of the present invention to provide such devices that are also integrated into the daily routine of those who possess the devices in order that the devices are readily available if ever needed.

SUMMARY OF THE INVENTION

In accordance with the foregoing objects, the present invention—a personal safety device for protection from a firearm attack generally comprises a conventional accessory item adapted for use other than as a personal safety device and a bullet resistant panel that is integrated into the conventional accessory item. In at least one implementation of the present invention, the conventional accessory item may comprise an item other than apparel or an apparel accessory that a user of the safety device may expect to ordinarily carry in the conduct of job related or other similar functions such as, for example, a clipboard as may be carried by a law enforcement or security officer. In at least one other implementation of the present invention, the conventional accessory item may comprise apparel or an apparel accessory item such as, for example, a backpack as may be worn or carried by a student.

Finally, many other features, objects and advantages of the present invention will be apparent to those of ordinary skill in the relevant arts, especially in light of the foregoing discussions and the following drawings, exemplary detailed description and appended claims.

BRIEF DESCRIPTION OF THE DRAWINGS

Although the scope of the present invention is much broader than any particular embodiment, a detailed description of the preferred embodiment follows together with illustrative figures, wherein like reference numerals refer to like components, and wherein.

DETAILED DESCRIPTION OF THE PREFERRED EMBODIMENT

Although those of ordinary skill in the art will readily recognize many alternative embodiments, especially in light of the illustrations provided herein, this detailed description is exemplary of the preferred embodiment of the present invention, the scope of which is limited only by the claims appended hereto.

Referring now to the figures generally, the personal safety device 10 of the present invention generally comprises a conventional accessory item adapted for use other than as a personal safety device and a bullet resistant panel that is integrated into the conventional accessory item. In at least one implementation of the present invention, the conventional accessory item may comprise an item other than apparel or an apparel accessory that a user of the safety device 10 may expect to ordinarily carry in the conduct of job related or other similar functions such as, for example, a clipboard 11 as may be carried by a law enforcement or security officer 34. In at least one other implementation of the present invention, the conventional accessory item may comprise apparel or an apparel accessory item such as, for example, a backpack 26 as may be worn or carried by a student.

Figure 1:
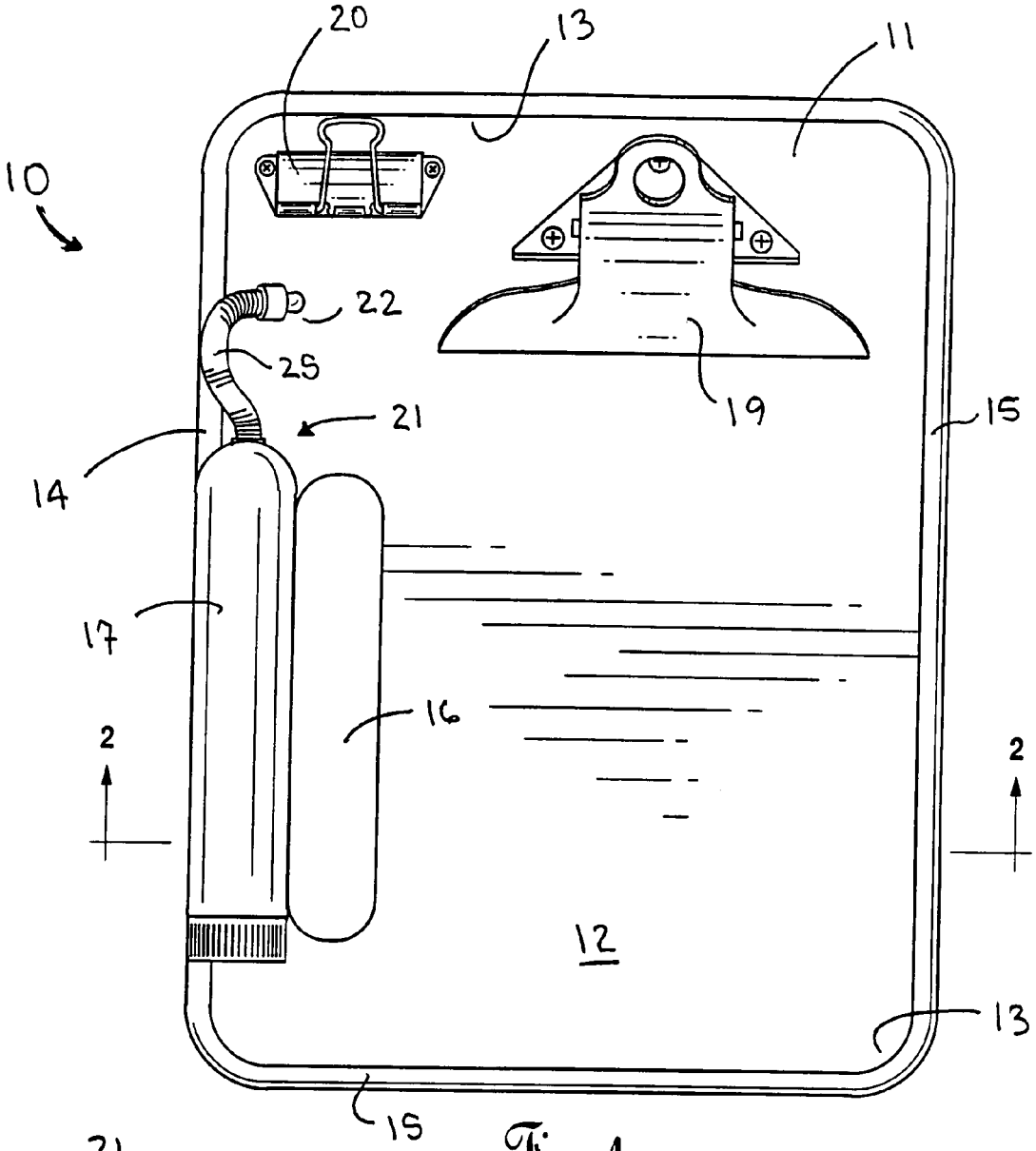
FIG. 1 shows, in a top plan view, the preferred embodiment of a first implementation of the personal safety device of the present invention.

In an implementation of the present invention comprising a clipboard 11, the clipboard 11 is preferably formed of a substantially planar panel 12, as particularly shown in FIG. 1, which panel 12 is manufactured from bullet resistant material and used in the ordinary course as a writing surface. As is conventional, the panel 11 is preferably provided with a document clip 19 and may also be provided with an additional clip 20 for use in holding an identification card or the like. Likewise, the panel 12 may be provided about its edges 13 with an aesthetic and/or protective edge treatment 15 as is known in the art. Although the edges 13 of the panel 12 may generally take any shape as may be desired in a particular implementation, at least a portion 14 of the edge 13 of the panel 12 should be substantially linear as will be better understood further herein.

Figure 3:
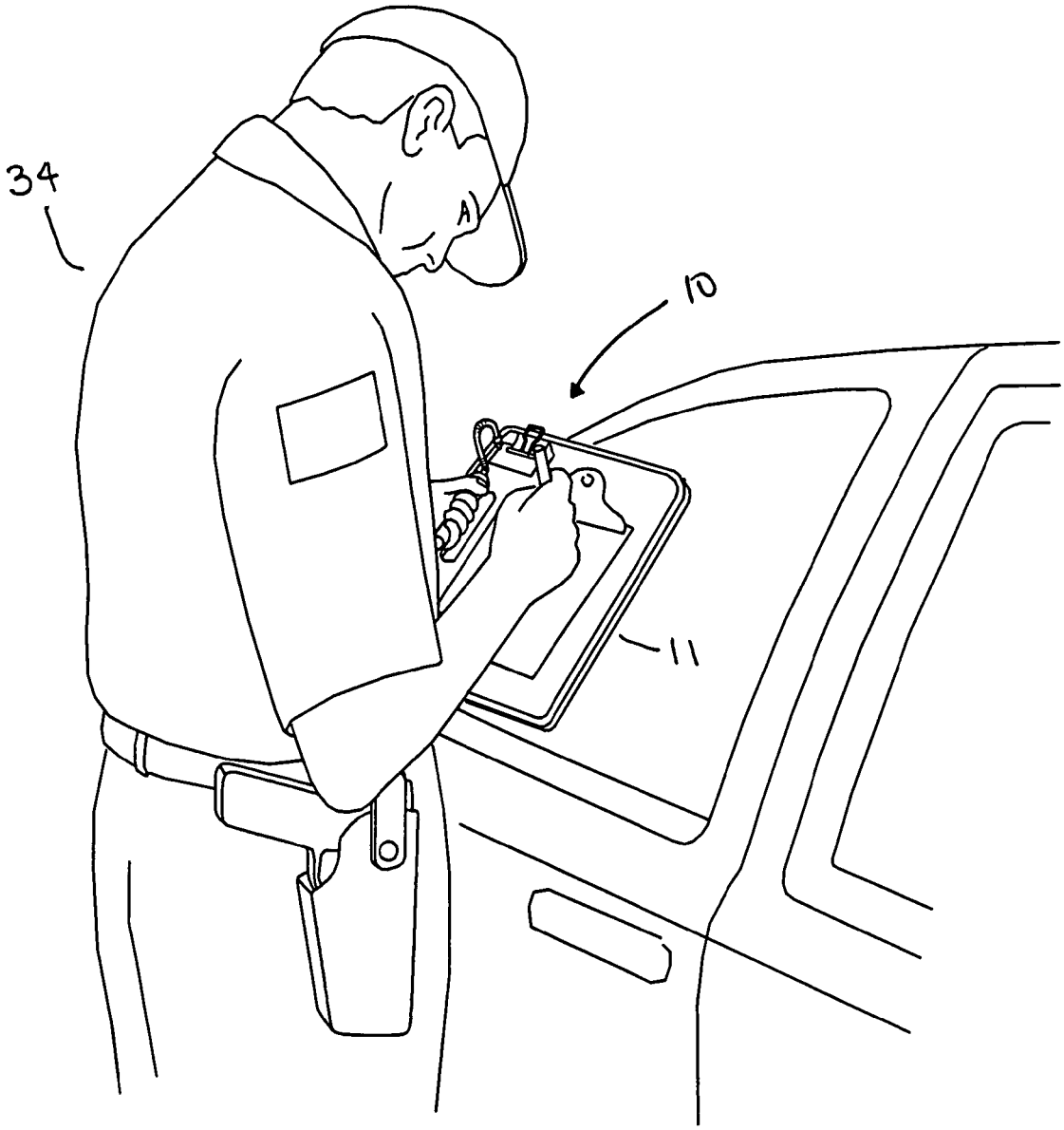
FIG. 3 shows, in a perspective view, the personal safety device of FIG. 1 as used by a law enforcement officer in the conduct of the officer's ordinary duties.
Figure 4:
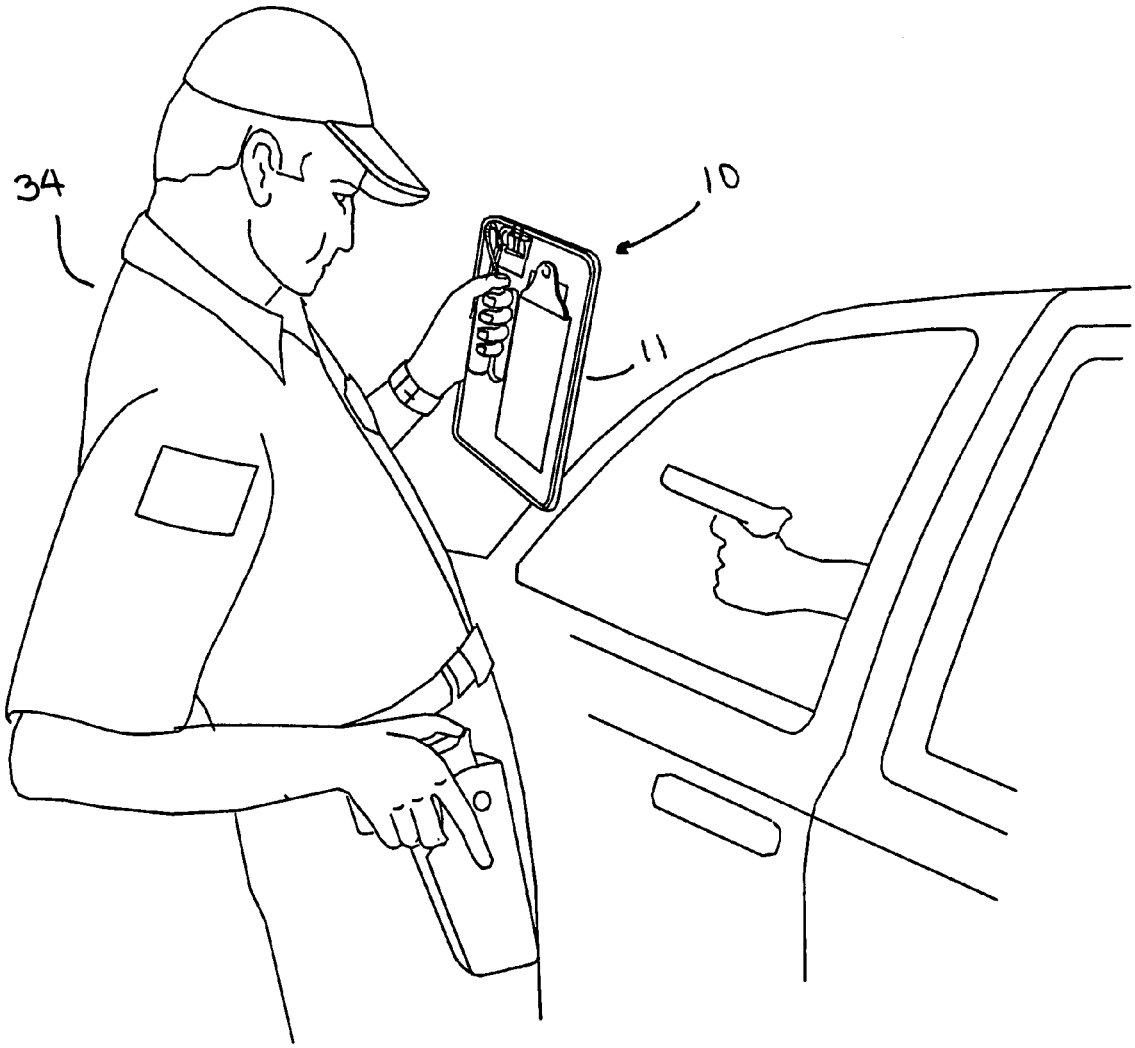
FIG. 4 shows, a perspective view generally corresponding to the view of FIG. 3, the personal safety device of FIG. 1 as used by a law enforcement officer for protection from a sudden firearm attack.

As a critical aspect of this implementation of the present invention, the clipboard 11 must be provided with a handhold 16 adapted and positioned such that should the user 34 of the clipboard 11 come under a firearm attack the manner in which the user 34 is holding the clipboard 11 will cause the bullet resistant panel 12 to be interposed into the line of fire under the ordinary reaction of the user 34. In particular, the handhold 16 is formed as an elongate orifice through the panel 12 substantially adjacent and parallel to the substantially linear portion 14 of the edge 13 of the panel 12. As shown in FIG. 3, the described arrangement will naturally cause the user 34 of the clipboard 11 to hold the clipboard 11 by gripping (with his or her weak hand) the panel 12 with thumb up and fingers under and up through the elongate orifice through the panel 12. In this manner, should the user 34 of the clipboard 11 come under an unexpected firearm attack while using the clipboard 11, the user's natural instinct to defensively raise his or her weak hand will result in the placement of the bullet resistant panel 12 directly in the unprotected line of fire while leaving free the user's strong hand for offensive retaliation, as shown in FIG. 4.

Figure 2:
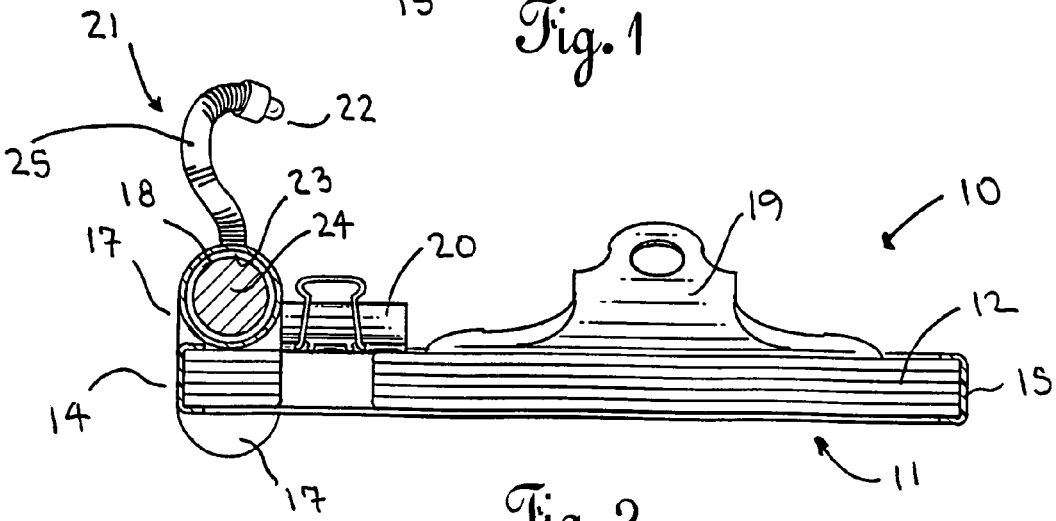
FIG. 2 shows, in a cross-sectional view taken through cut line 2-2 of FIG. 1, various details of the construction of the personal safety device of FIG. 1.

In order to ensure that the user 34 maintains a secure grasp of the clipboard 11 under such a circumstance, the clipboard 11 is preferably provided with a grip 17 as particularly shown in FIG. 2. The grip 17, which may comprise a semi-rigid rubber or plastics material, is preferably elongate for provision on the clipboard 11 in the area between the elongate orifice therethrough and the substantially linear portion 14 of the edge 13 thereof. As shown in FIG. 2, the grip 17 may comprise a plurality of appurtenances to the panel 12, each of which is preferably generally semicircular in cross section in order to better conform to the user's grip. Although the preferred embodiment comprises such an arrangement, it is noted that the present invention may also be implemented with a single appurtenance or with a grip 17 integrally formed of the material of construction of the panel 12.

In order to ensure that the user 34 of the clipboard 11 holds the clipboard 11 in the manner as has been described, it is preferable that the clipboard 11 also be provided with a lighting fixture 21 attached thereto. In this manner, the user 34 will not be tempted to adopt an alternative manner of holding the clipboard 11 in an attempt to also hold a flashlight. In such embodiments as may include this provision it is noted that the grip 17 may double as a battery compartment 23 or a battery compartment 23 may be otherwise implemented within the internal space 18 of a portion of the grip 17. The light source 22, which may comprise an energy efficient light emitting diode or any other light source, is in any case preferably affixed to the battery compartment 23 and batteries 24 therein through a flexible neck 25. In this manner, the user may adjust the light cast from the lighting fixture 21 as desired, thereby doubly ensuring that the user 34 will naturally properly hold the clipboard 11 during ordinary tasks.

Figure 5:
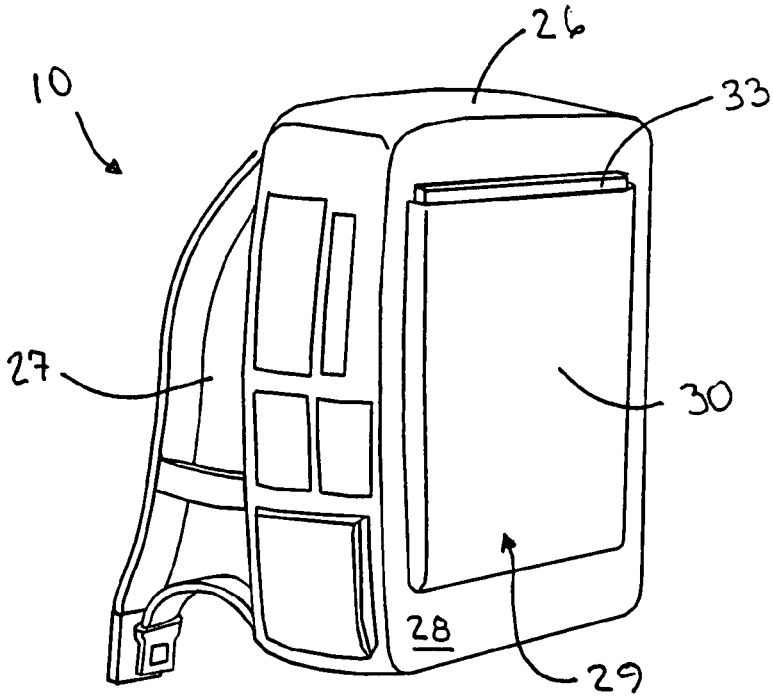
FIG. 5 shows, in a perspective view, a first preferred embodiment of a second implementation of the personal safety device of the present invention.
Figure 6:
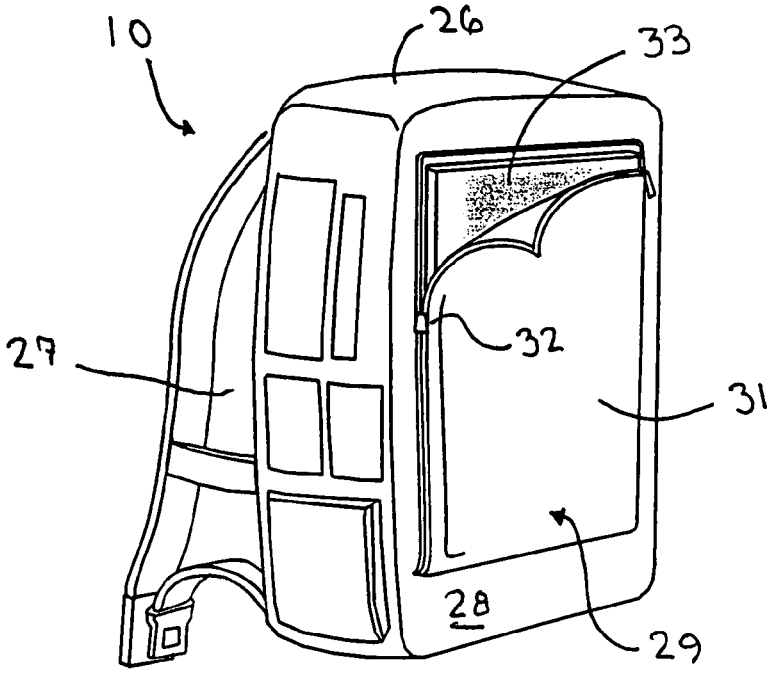
FIG. 6 shows, in a perspective view, a second preferred embodiment of the personal safety device of FIG. 5.

In an implementation of the present invention comprising a bullet resistant backpack 26, an otherwise conventional backpack 27 is provided with a compartment 29 that is adapted to receive therein a bullet resistant panel 33. The compartment is further preferably adapted to maintain the orientation of the panel 33 such that if a wearer of the backpack 26 is fleeing from an assailant the planar surface of the panel 33 will be generally perpendicular to the line of fire, thereby affording maximum protection to the wearer. The compartment 29 may be formed as a scabbard 30 into which the panel 33 may be slipped (as shown in FIG. 5), formed as a pocket 31 in which the panel 33 may be secreted (as shown in FIG. 6) or may be formed in any other substantially equivalent manner. In the case of a pocket 31, a zipper 32 or other closure may be provided. Additionally, although for exemplification of the present invention the compartment 29 is shown on the outside of the bullet resistant backpack 26, it should be noted that the compartment 29 may also be provided in the interior of the backpack 26.

Still further, it is noted that the compartment 29 is shown to be provided adjacent the back side 28 of the backpack 26. Although not critical to the implementation of the present invention, it is additionally noted that such implementation is preferred inasmuch as placement of the bullet resistant panel 33 such that the body of the backpack 26 and contents thereof are interposed the line of fire and the wearer's body allows the body of the backpack 26 and contents thereof to act as a cushion. This is especially important when the wearer of the backpack 26 is a child as all steps possible should be taken to disperse the very powerful force with which a bullet will impact the panel 33.

While the foregoing description is exemplary of the preferred embodiment of the present invention, those of ordinary skill in the relevant arts will recognize the many variations, alterations, modifications, substitutions and the like as are readily possible, especially in light of this description, the accompanying drawings and claims drawn thereto. In any case, because the scope of the present invention is much broader than any particular embodiment, the foregoing detailed description should not be construed as a limitation of the scope of the present invention, which is limited only by the claims appended hereto.

What is claimed is:

1. A personal safety device for protection from a firearm attack, said personal safety device comprising:

a clipboard adapted for use other than as a personal safety device;

a bullet resistant panel, said bullet resistant panel being integrated into said clipboard; and wherein:

said clipboard comprises a substantially planar panel; and said planar panel comprises:

a writing surface bounded by at least one substantially linear edge; and an elongate handhold adjacent said linear edge, said handhold comprising an elongate orifice through said panel; and a grip for facilitating a secure grasp of said clipboard, said zip comprising an elongate appurtenance having a generally semicircular cross section and being affixed to said panel between said linear edge of said panel and said elongate orifice through said panel.

2. The personal safety device as recited in claim 1, said personal safety device further comprising a lighting fixture attached to said clipboard.

3. The personal safety device as recited in claim 2, wherein said lighting fixture comprises a battery operated light source.

4. The personal safety device as recited in claim 3, wherein said light source comprises a light emitting diode.

5. The personal safety device as recited in claim 3, wherein said lighting fixture comprises a battery compartment.

6. The personal safety device as recited in claim 5, wherein said light source is connected to said battery compartment through a flexible neck.

7. A personal safety device for protection from a firearm attack, said personal safety device comprising:

a clipboard adapted for use other than as a personal safety device;

a bullet resistant panel, said bullet resistant panel being integrated into said clipboard;

wherein:

said clipboard comprises a substantially planar panel; and said planar panel comprises:

a writing surface bounded by at least one substantially linear edge;

an elongate handhold adjacent said linear edge, said handhold comprising an elongate orifice through said panel;

a grip for facilitating a secure grasp of said clipboard, said grip comprising a plurality of elongate appurtenances wherein each said elongate appurtenance has a generally semicircular cross section and is affixed to said panel between said linear edge of said panel and said elongate orifice through said panel; and a lighting fixture attached to said clipboard, wherein said lighting fixture comprises:

a battery operated light source; and a battery compartment, said battery compartment being disposed within an interior space of one of said appurtenances.

8. The personal safety device as recited in claim 7, wherein said battery compartment is formed integral with one of said appurtenances.

9. The personal safety device as recited in claim 8, wherein said light source comprises a light emitting diode.

10. The personal safety device as recited in claim 7, wherein said light source comprises a light emitting diode.

11. A personal safety device for protection from a firearm attack, said personal safety device comprising:

a clipboard;

a bullet resistant panel integrated into said clipboard;

wherein:

said clipboard comprises a substantially planar panel; and said planar panel comprises:

a writing surface bounded by at least one substantially linear edge;

an elongate handhold adjacent said linear edge, said handhold comprising an elongate orifice through said panel;

a grip for facilitating a secure grasp of said clipboard, said grip comprising an elongate appurtenance having a generally semicircular cross section and being affixed to said panel between said linear edge of said panel and said elongate orifice through said panel; and a lighting fixture attached to said clipboard, wherein said lighting fixture comprises:

a battery operated light source; and a battery compartment, said battery compartment being disposed within an interior space of said appurtenance.

12. The personal safety device as recited in claim 11, wherein said battery compartment is formed integral with said appurtenance.

13. The personal safety device as recited in claim 12, wherein said light source comprises a light emitting diode.

14. The personal safety device as recited in claim 11, wherein said light source comprises a light emitting diode.

* * * * *